US005918483A

United States Patent [19]

Schmid et al.

[11] Patent Number: 5,918,483

[45] Date of Patent: Jul. 6, 1999

[54] FLATBED KNITTING MACHINE WITH SINKER CONTROL FOR YARN LOOP RETENTION

[75] Inventors: Franz Schmid, Bodelshausen; Gerhard Goetz, Reutlingen, both of Germany

[73] Assignee: H. Stoll GmbH & Co., Reutlingen, Germany

[21] Appl. No.: 09/018,403

[22] Filed: Feb. 4, 1998

[30] Foreign Application Priority Data

Feb. 7, 1997 [DE] Germany ..... 197 04 644

[51] Int. Cl.[6] ..... D04B 7/04

[52] U.S. Cl. ..... 66/64; 66/106; 66/109

[58] Field of Search ..... 66/64, 106, 109, 66/111, 104

[56] References Cited

U.S. PATENT DOCUMENTS

| | | | |
|---|---|---|---|
| 1,499,138 | 6/1924 | Ames | 66/106 |
| 3,735,812 | 5/1973 | Flavell et al. | 66/104 |
| 5,134,864 | 8/1992 | Yabuta et al. | 66/106 |
| 5,138,849 | 8/1992 | Stoll et al. | 66/104 |
| 5,231,854 | 8/1993 | Schmid et al. | 66/64 |
| 5,408,849 | 4/1995 | Schimko et al. | 66/106 |

FOREIGN PATENT DOCUMENTS

| | | |
|---|---|---|
| 36 09 539 C2 | 12/1987 | Germany . |
| 39 35 763 C2 | 2/1993 | Germany . |
| 41 28 016 A1 | 2/1993 | Germany . |

*Primary Examiner*—Andy Falik
*Attorney, Agent, or Firm*—Michael J. Striker

[57] ABSTRACT

The flatbed knitting machine includes opposing needle beds (V,H) with longitudinally movable needles (11,12); a carriage provided with cams (14,15,16) and sinkers (17,18; 17',18'; 17",18") having a closed position (S1), an end position (S2) and an open position (S0) and movable between the needles (11,12) with the help of the cams (14,15,16) in the carriage. The sinkers (17,18; 17',18'; 17", 18") each have a hook-shaped projection (25, 26; 25', 26') that occludes or encloses from above a side of a loop on an adjacent needle in the needle beds when the sinkers are in the closed position.

11 Claims, 20 Drawing Sheets

FLATBED KNITTING MACHINE WITH SINKER CONTROL FOR YARN LOOP RETENTION

BACKGROUND OF THE INVENTION

The present invention relates to a flatbed knitting machine with opposing needle beds with longitudinally displaceable needles, between which adjustable sinkers are arranged with the help of cams of a carriage.

This type of flatbed knitting machine has been described, for example, in German Patent Documents DE-PS 36 09 539, DE-PS 39 35 763 and DE-OS 41 28 0160. The sinkers of these flatbed knitting machines hold the old loops hanging on the needles back during the needle extension motion, since the two opposing sinkers of both needle beds form bridging members spanning the cam gap in their closed position next to the needle Here the sinkers have projections which form these bridging members over the cam gap with the sinkers in the closed position. On extension of the needles the loops come into contact on the contacting portions of these projections A reliable retention or holding of the old loops is thus only obtained when both projections bear or rest against each other.

SUMMARY OF THE INVENTION

It is an object of the present invention to provide a flatbed knitting machine having sinkers which alone can hold the old loops back during the needle extension by the associated sinker of the needle bed of that needle.

According to the invention this object is attained in a flatbed knitting machine of the above-described type comprising opposing needle beds with longitudinally movable needles; cams included in a carriage and sinkers having a closed position and movable between the needles with the help of the cams in the carriage; wherein the sinkers are each provided with a hook-shaped projection, which occludes or encloses a side of a loop on an adjacent needle of a needle bed from above in the closed position of the sinkers. The occluded or enclosed loop side is however not clamped, but can only move downward. Thus it is not necessary for the hook-shaped projections of both sinkers to contact each other in their closed position, but they could certainly do so. The sinkers can be movable between an open position and a standard closed position. In this standard closed position the loops are reliably held back or retained, when the needle is advanced forward. According to the yarn and fabric type the sinkers can be movable with their hook-shaped projections continuously from their closed position into the cam gap of the machine until at an end position to define a loop containing space, whereby the new loop forming process is more reliable. After extension of the needle into its end position the sinkers can be brought again into their closed position, whereby the tension on the old loops is reduced and the fabric is reliably held in the machine containing space. The closed position can be reached from the open position by a rotary motion and the end position can be reached by superimposing the translational and rotational motions, so that the hook-shaped projections of the sinkers perform a nearly vertical motion. The sinkers each have at least one elongated hole with which they are mounted rotatably and translationally on respective pivot shafts of the needle beds in order to be able to move them into the different positions. Two elongated holes are preferably provided on each sinker, with which each sinker is mounted on two pivot shafts. In a first preferred embodiment the sinkers can cooperate with stationary loop formers. In another embodiment the front regions of the sinkers are formed as loop formers.

The process for making a knit article of a predetermined fabric type from yarn according to the invention with the flatbed knitting machine comprises the steps of:

a) closing each of the sinkers with the associated needle in a rest position, so as to enclose or occlude a side of a loop suspended from or hanging on the needle and to narrow the loop containing chamber or space by motion of the sinker in the direction of its end position;

b) extending the needle into a final position while the sinkers remain closed;

c) subsequently releasing the loop containing space by moving the sinkers into their closed position;

d) shortly before retracting the needle and the insertion of the yarn pivoting the sinkers into their open position;

e) subsequently closing the sinkers shortly before the needles are advanced from the loop forming position to the cam level; and f) according to the fabric type subsequently opening the sinkers or holding them in their closed and end positions.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
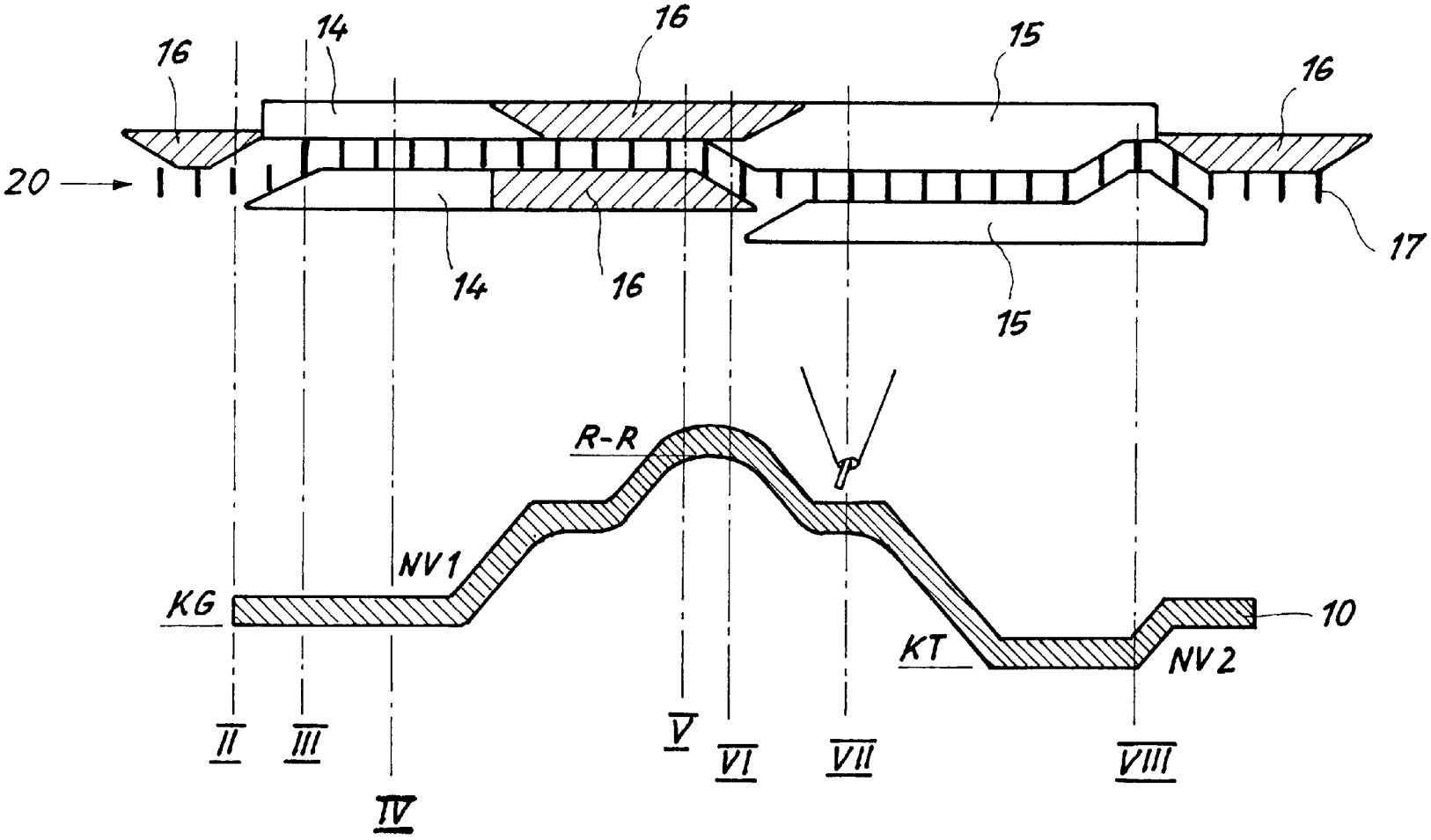
FIG. 1 is a schematic diagram of a knitting cam of a flatbed knitting machine with stationary and movable cams for sinker control.

FIG. 1 shows a cam groove 10 for control of the needles 11 and 12 of front needle bed V and rear needle bed H (FIG. 2) which is formed by cams not shown in further detail here. Furthermore stationary cams 14,15 and movable cams 16 for control of the sinkers are shown in the drawing. The movable cams 16 are shown shaded to distinguish them better from the stationary cams 14,15. These cams border on an additional groove 20 for the sinkers 17,18. The knitting direction is shown by the arrow 19. FIG. 1 shows the knitting cam for knitting of loops. The rest position of the needles at cam level is given by KG, while NV1 gives the needle advance for loop formation. The needle position of greatest extension during knitting is indicated with R—R. KT indicates the deepest loop forming position, from which the needles are brought again by a second advance NV2 to the cam level KG. The exact position of the needles 11,12 and the sinkers 17,18 of the front and rear needle beds V,H during the loop forming process is illustrated in the cross-sectional views of FIGS. 2 to 8.

Figure 2:
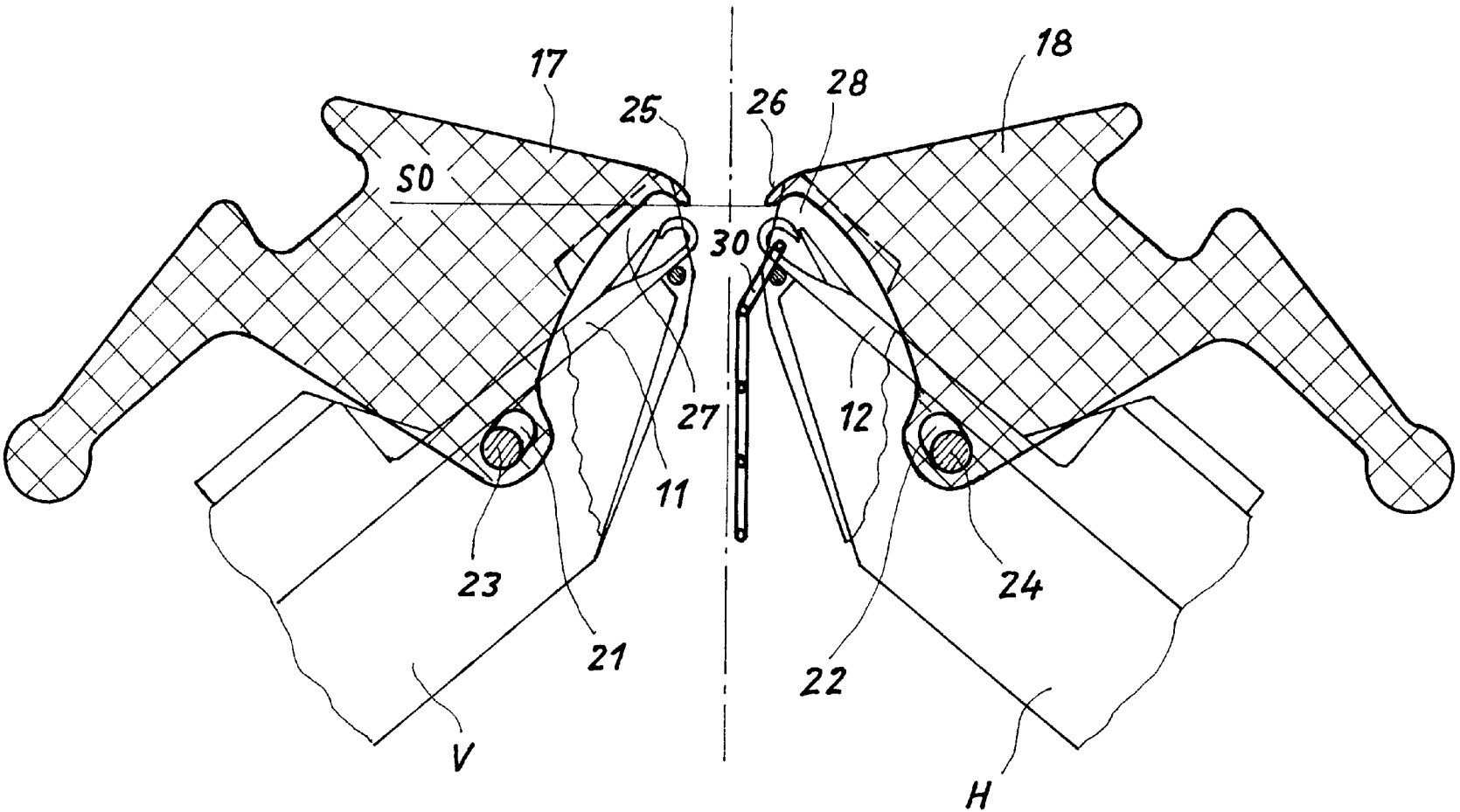
FIG. 2 is a cross-sectional view of a cam gap region of the flatbed knitting machine taken along the section line II—II of FIG. 1.

As shown in FIG. 2, the sinkers 17 and 18 are provided with respective elongated through going holes 21 and 22 and are mounted on the pivot shafts 23 and 24 of both needle beds V,H with the pivot shafts in the holes. In FIG. 2 the sinkers 17 and 18 are shown in a completely open position S0. Then sinkers 17 and 18 have hook-like projections 25 and 26, whose tips overlap the upper ends of the front edges of a stationary loop former 27,28 in the illustrated embodiment of the sinkers 17 and 18. Because of that it is guaranteed that the loop 30 hanging on the needle 12 cannot slid beyond the upper side of the loop formers 27,28 and subsequently is held between the sinkers 17 and 18 and the loop formers 27,28 during the sliding-motion of the sinkers 17 and 18. The needles 11 and 12 are located in the position illustrated in FIG. 2 at the cam level.

Figure 3:
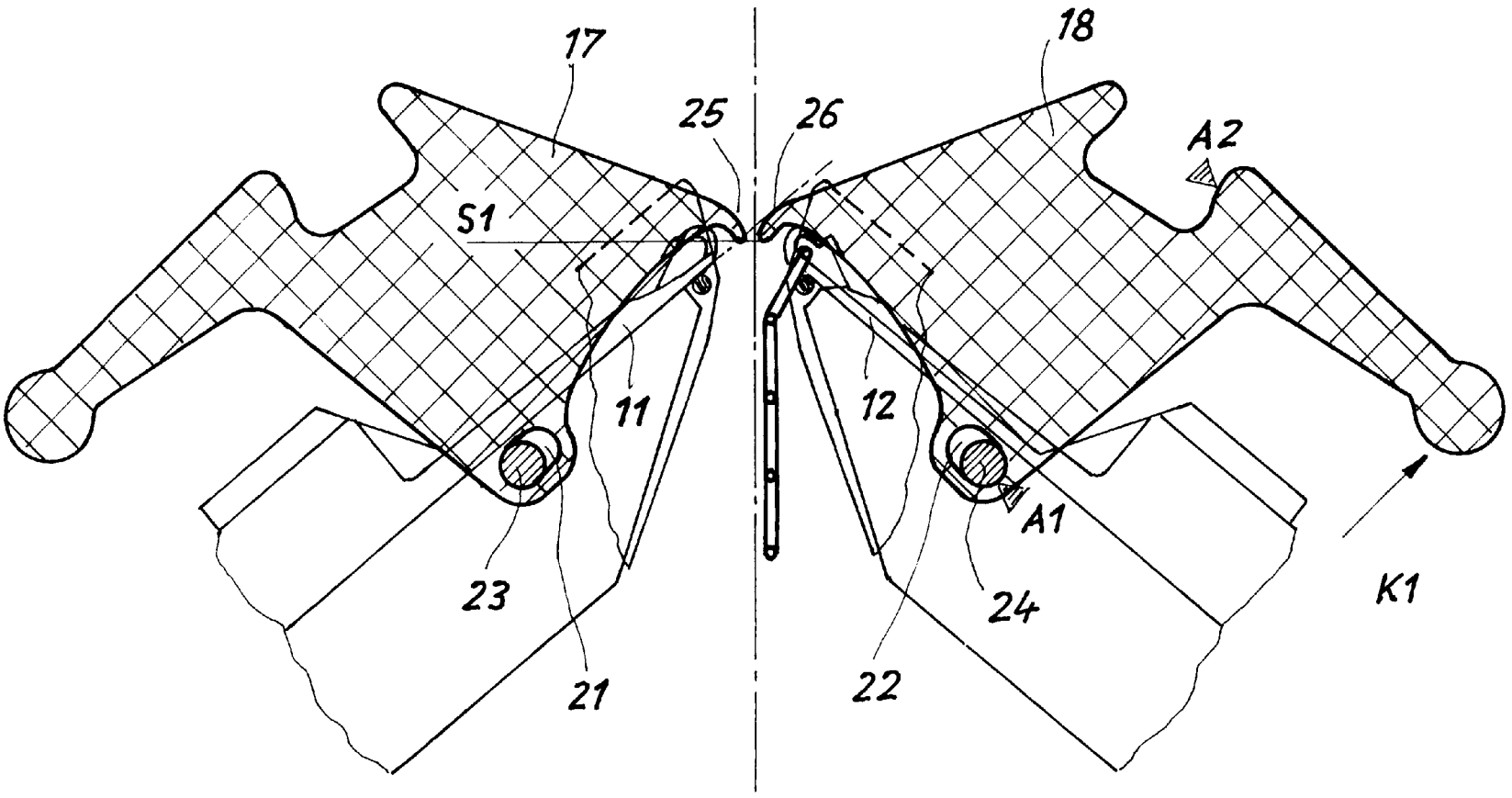
FIG. 3 is a cross-sectional view of a cam gap region of the flatbed knitting machine taken along the section line III—III of FIG. 1.

In FIG. 3 the needles 11 and 12 are at rest. The sinkers 17 and 18 perform a rotary motion around the pivot shafts 23, 24. The sinkers 17 and 18 thus attain their closed position S1. The rotary motion of the sinkers 17 and 18 is the result of the applied force K1. The sinkers 17,18 are supported at position A1 of the elongated holes 21,22. The rotary motion is limited by a motion stop A2 formed by cams. The nose-shaped projections 25,26 of the sinkers 17, 18 are on the same level as the needle base. Furthermore they are close to each other in the center plane of the needle beds so that both sinkers 17 and 18 together define a loop compartment or space in a region under the needle bases.

Figure 4:
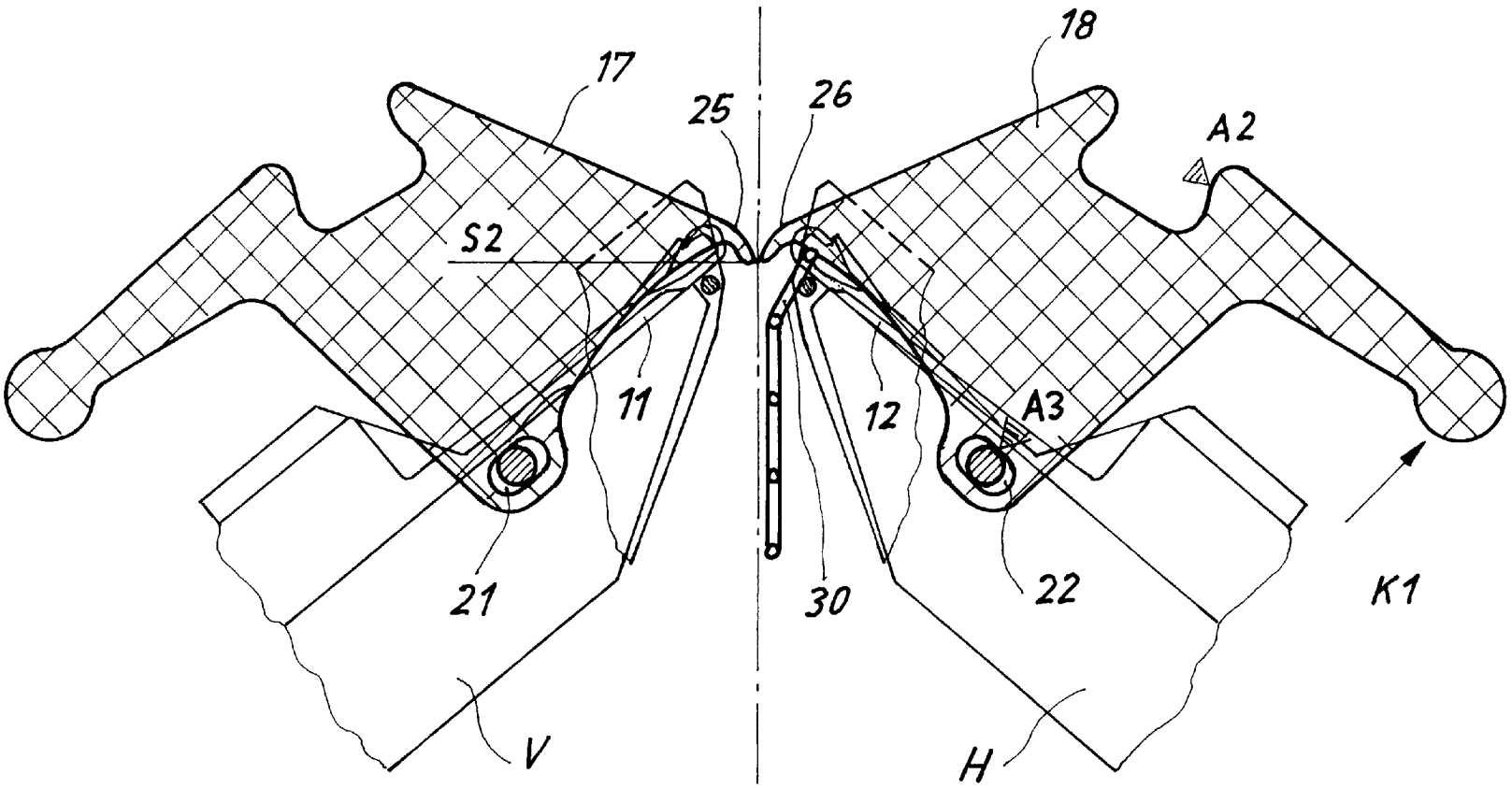
FIG. 4 is a cross-sectional view of a cam gap region of the flatbed knitting machine taken along the section line IV—IV of FIG. 1.

In FIG. 4 the needles 11 and 12 are always still at rest. Because of an additional application of the force K1 and support of the sinkers 17,18 at A2, the sinkers 17 and 18 now perform a rotary motion about the pivot shafts 23,24, which is superimposed on a translational motion along the shafts in the elongated holes 21,22, whereby the projections 25,26 of the sinkers perform a nearly vertical downward motion. The sinkers 17 and 18 have now reached their end position S2 and rest approximately in the central plane of both needle beds V,H. Because of that, the loops 30 hanging on the needle 12 are enclosed, but not held fixed. The loop containing space is displaced still further downward by the vertical motion of the hook-like projections 25 and 26 of the sinkers 17 and 18 by the vertical motion of the hook-like projections 25 and 26, whereby the reliability of the additional loop forming processes is improved.

Figure 5:
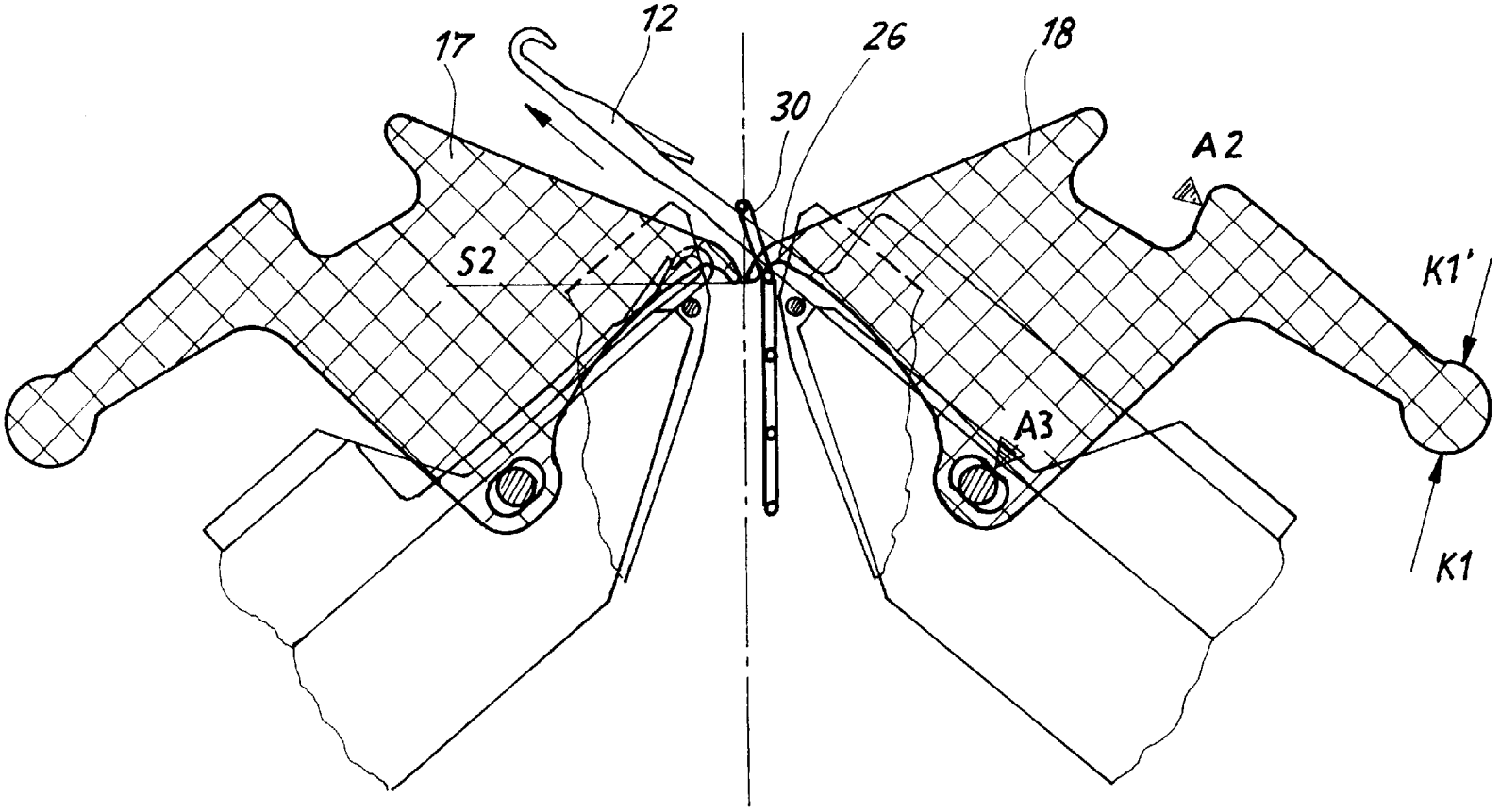
FIG. 5 is a cross-sectional view of a cam gap region of the flatbed knitting machine taken along the section line V—V of FIG. 1.

In FIG. 5 the needles 12 are driven out into their end positions R—R. The sinkers 17 and 18 remain in their end position S2. An automatic opening of the sinkers 17 and 18 is not possible since the cams 16 exert an opposing force K1 and K1' on the sinkers 17 and 18. By the advance of the needles 12 the loops 30 are taken from the shaft of the needles 12 in the motion direction. The projection 26 of the enclosing sinker 18 limits the displacement of the loop 30, whereby this retaining force acts exactly opposite to the advance direction of the needle 12 because of the geometry and position of the hook-like projection 26.

Figure 6:
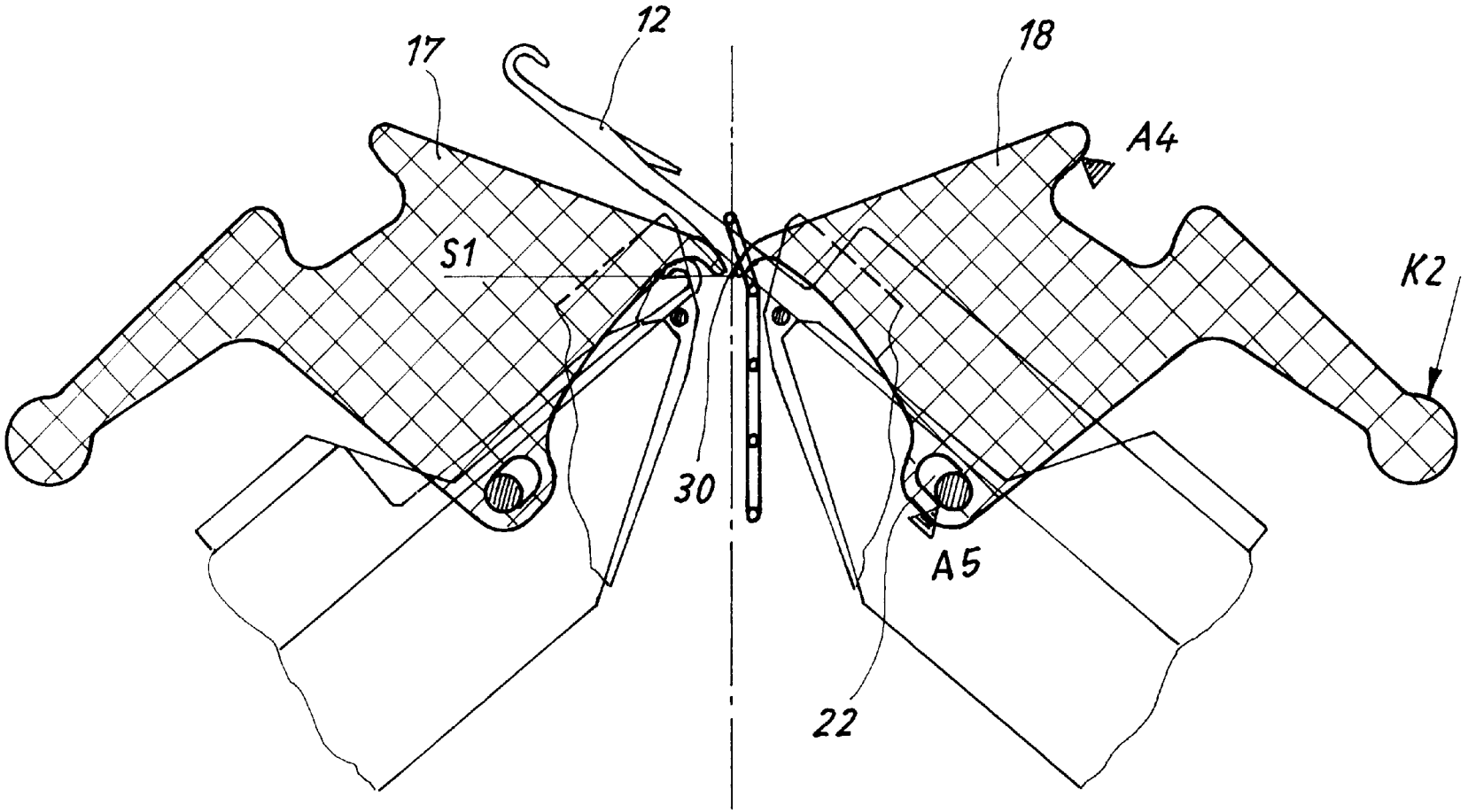
FIG. 6 is a cross-sectional view of a cam gap region of the flatbed knitting machine taken along the section line VI—VI of FIG. 1.

In FIG. 6 the needles 12 are as before in their end position R—R while the sinkers 17 and 18 are moved back again into their standard cam closed position S1 by action of a force K2 exerted by the cams. The motion of the sinkers 17 and 18 consists of a rotary motion about the point A4 and a translational motion along the shaft in the elongated hole 22. The tension on the sinker loops 30 is reduced by the partial opening of the sinkers 17 and 18. The knit fabric is held by the needles 12 in the loop containing space.

Figure 7:
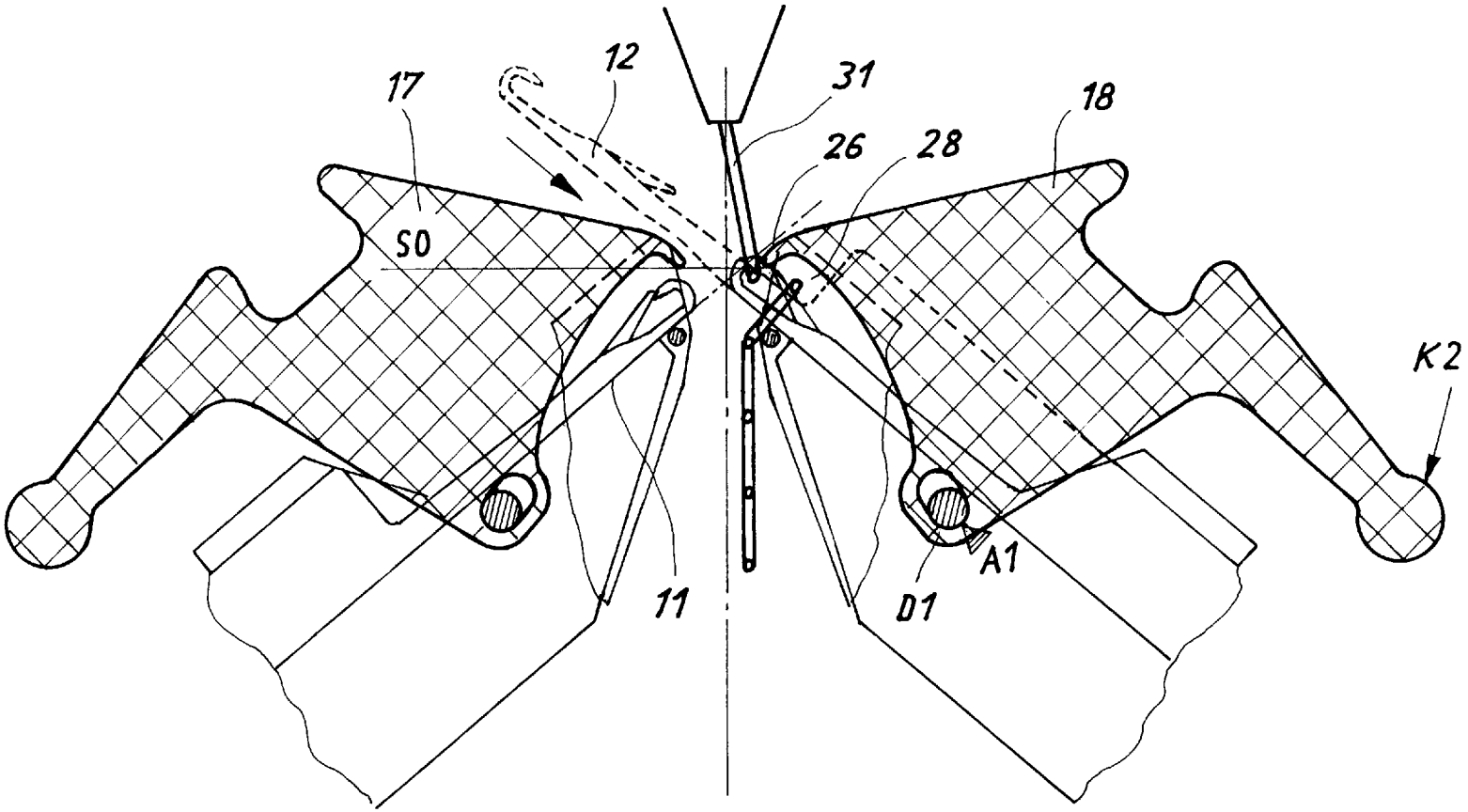
FIG. 7 is a cross-sectional view of a cam gap region of the flatbed knitting machine taken along the section line VII—VII of FIG. 1.

In FIG. 7 the sinkers 17 and 18 are again brought into their open position S0, and the needles 12 begin their return motion. The opening motion of the sinkers 17 and 18 is produced by the application of the force K2. Since the projection 26 of the sinker 18 covers the upper side and front side of the loop formers 18, the reliability of the yarn threading is very highs The projections 25,26 of the sinkers 17 and 18 in no stage of the sinker motion go beyond the level of the needle base of the opposing needle beds, whereby a complete sinker motion is guaranteed with extended needles 11,12.

Figure 8:
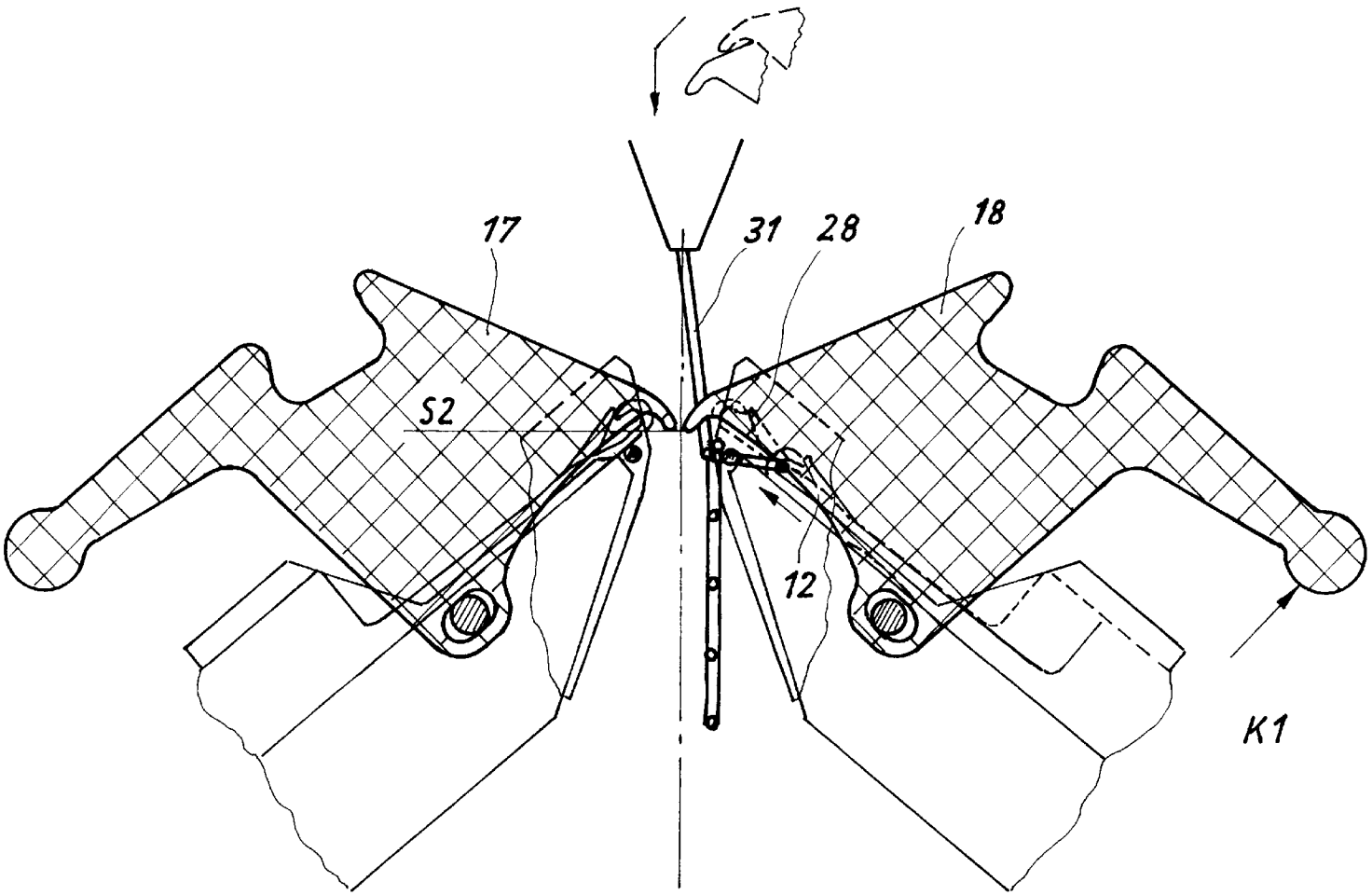
FIG. 8 is a cross-sectional view of a cam gap region of the flatbed knitting machine taken along the section line VIII—VIII of FIG. 1.

In FIG. 8 the needles 12 are advanced from the respective loop forming position KT to the cam level KG (FIG. 1). Because of that the sinkers 17 and 18 move until at their end position S2. Because of that the pulling in of the yarn 31 by the needle hooks during the advance of the needles 12 is thereby prevented. Since the closed sinkers 17,18 always hold the input yarn 31 at a level at which it can be easily engaged by or grasped with the needles 11,12, a comparatively large yarn flow is possible.

Figure 9:
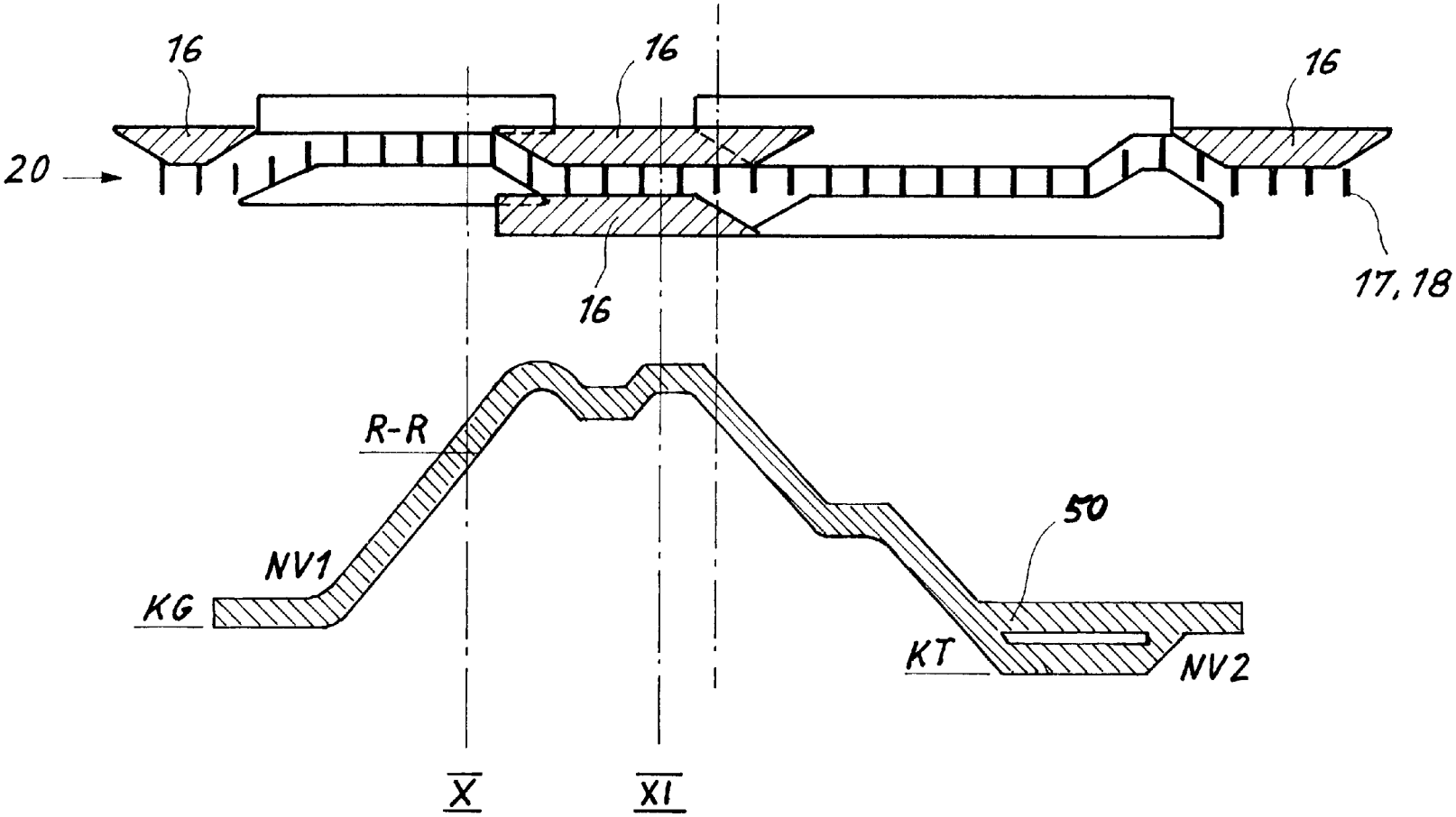
FIG. 9 is a schematic diagram corresponding to FIG. 1 of a knitting cam for illustration of machine take-up processes.
Figure 10:
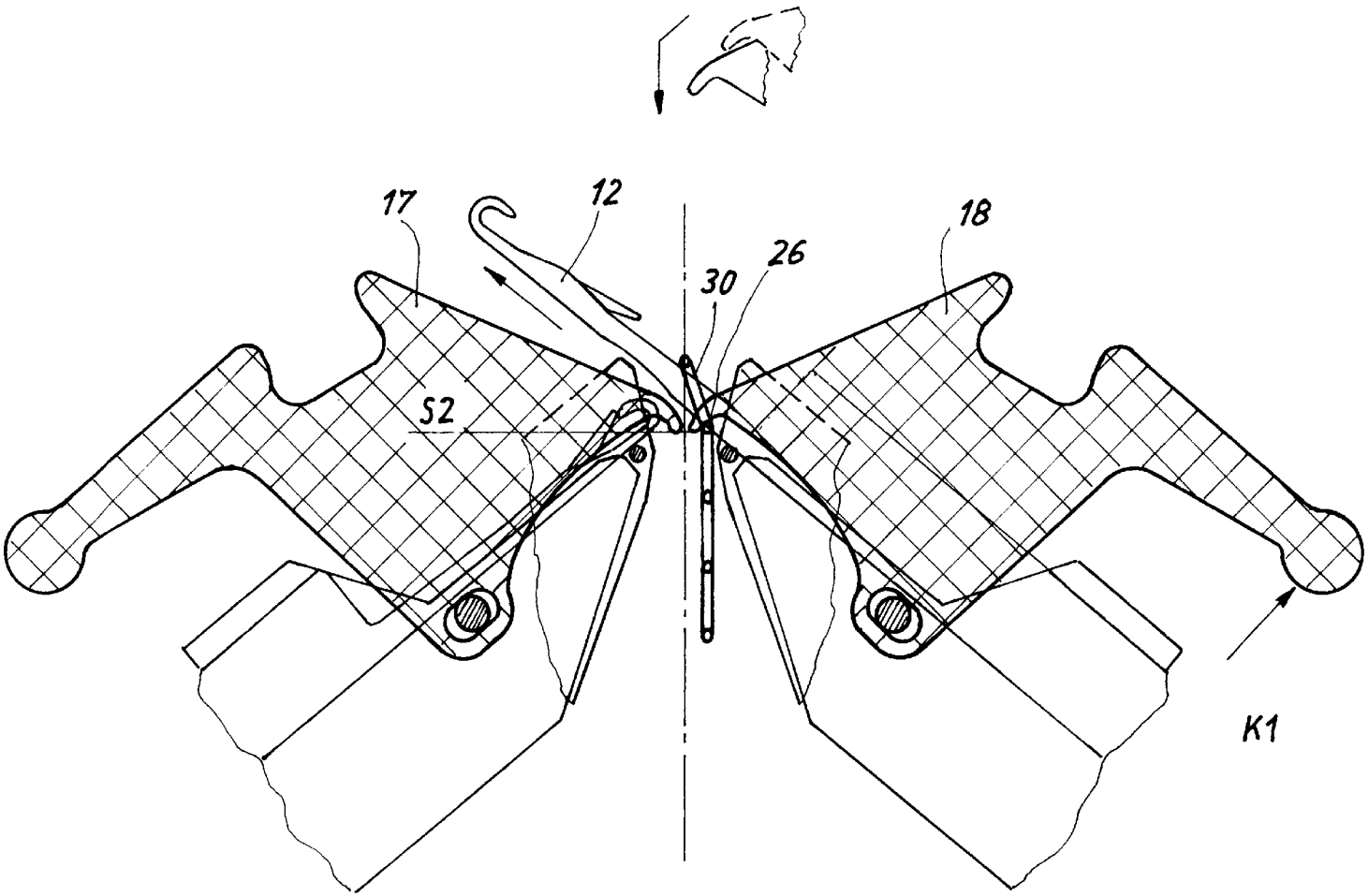
FIG. 10 is a cross-sectional view of a cam gap region of the flatbed knitting machine taken along the section line X—X of FIG. 9.
Figure 11:
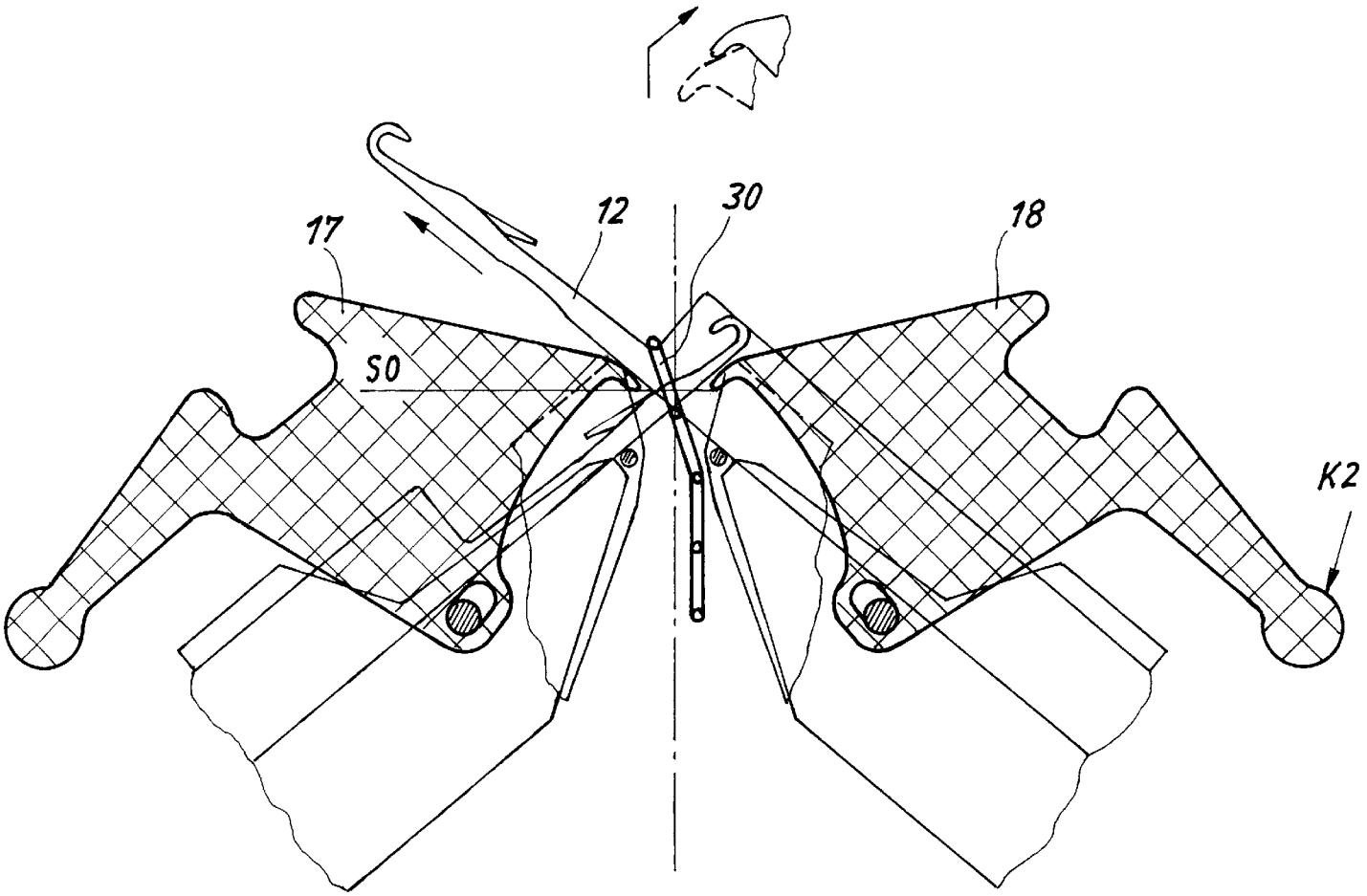
FIG. 11 is a cross-sectional view corresponding to FIG. 10 of a cam gap region of the flatbed knitting machine taken along the section line XI—XI of FIG. 9.

FIG. 9 shows an embodiment corresponding to FIG. 1 of the cam for influencing the sinkers 17,18 and the needles 11,12 during a looping process. FIGS. 10 and 11 show the positions of the needles 11 and 12 and the sinkers 17 and 18 in a cross-section through the cam gap region of the knitting machine of FIG. 1 taken along the section lines X and XI.

In FIG. 10 the needles 12 are advanced until in the position R—R. The sinkers 17 and 18 are in their end position S2. The loops 30 are retained or held back in a manner similar to that shown and described in connection with FIGS. 2 to 5. Subsequently the needles 12 are advanced until at their delivery position according to FIG. 11. The confined sinkers 17,18 are opened parallel until maximum in the position S0. The opening degree depends on the type of fabric and is set by the moving cams 160 Thus tension on the loops 30 to be delivered is avoided, so that a splitting of the loops is counteracted. The slinging or looping process is thus substantially more reliable because of that. After the slinging or looping process the needles are either brought back to the cam level KG or to the loop forming position KT (FIG. 9) in so far as the needles form loops by a split engineering method. In this latter case an advance of the needles to the cam level KG and an opening of the sinkers 17,18 occurs subsequently.

Figure 12:
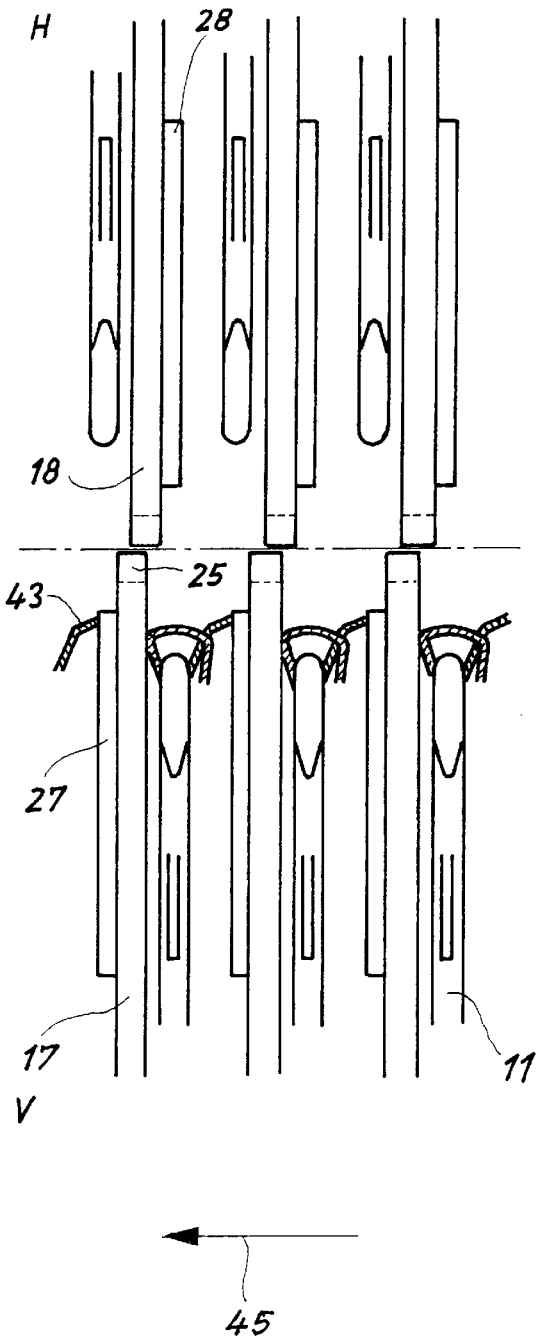
FIG. 12 is a partial top view of a cam gap region of the flatbed knitting machine at position IV in FIG. 1 during making of a flat knit fabric.
Figure 13:
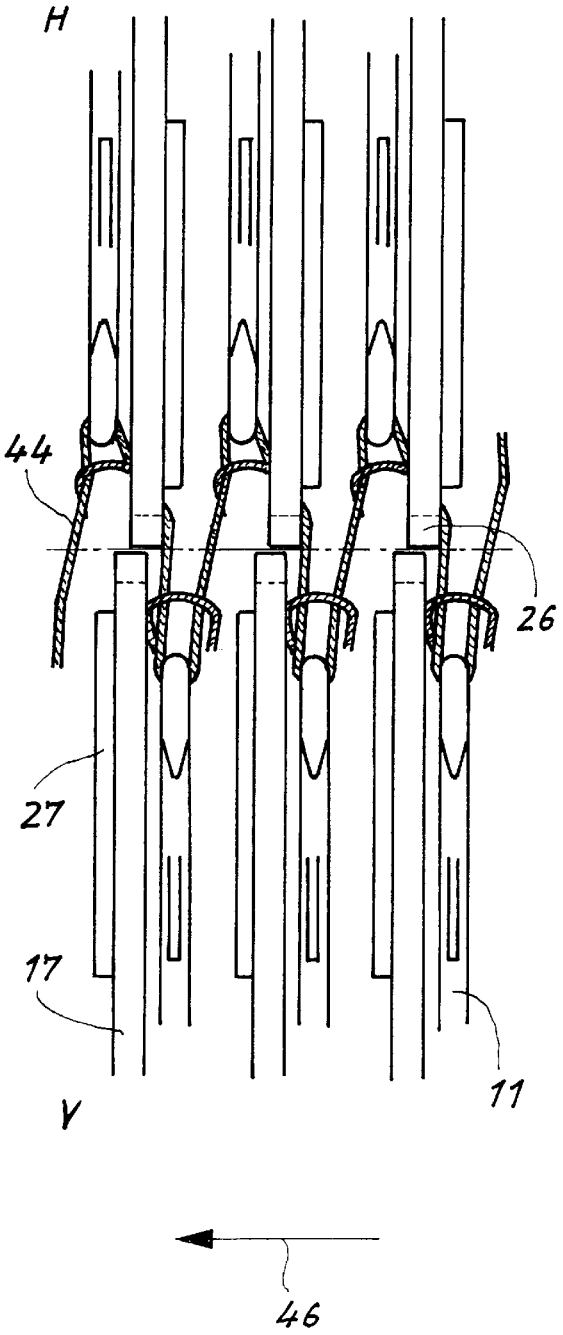
FIG. 13 is a partial top view corresponding to FIG. 12 of a cam gap region of the flatbed knitting machine during the making of a double-sided knit fabric.

In FIGS. 12 and 13 a close arrangement of the sinkers 17 and 18 of the needle beds V and H is illustrated. The sinkers 17 and 18 are in their end position S2. Stationary loop formers 27,28 are arranged beside the sinkers 17,18. In the flat knit fabric 43 shown in FIG. 12 the projections 25,26 engage over a side of the loops on the adjacent needle of the same needle bed in a similar way as in the two-sided knit fabric 44 according to FIG. 13. The arrows 45 and 46 indicate the knitting direction.

Figure 14:
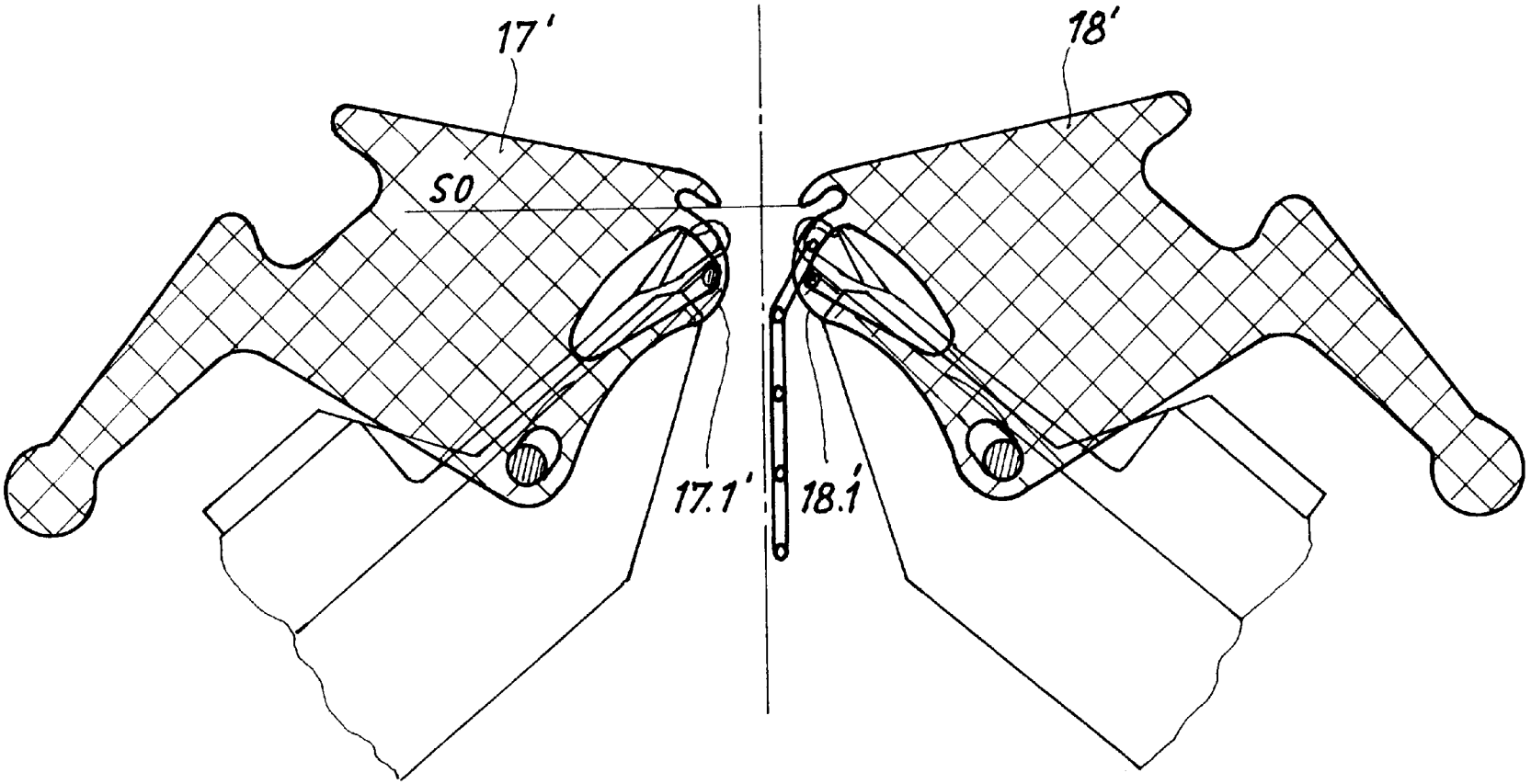
FIG. 14 is a cross-sectional view corresponding to that of FIG. 2 with a second embodiment of the sinkers.
Figure 15:
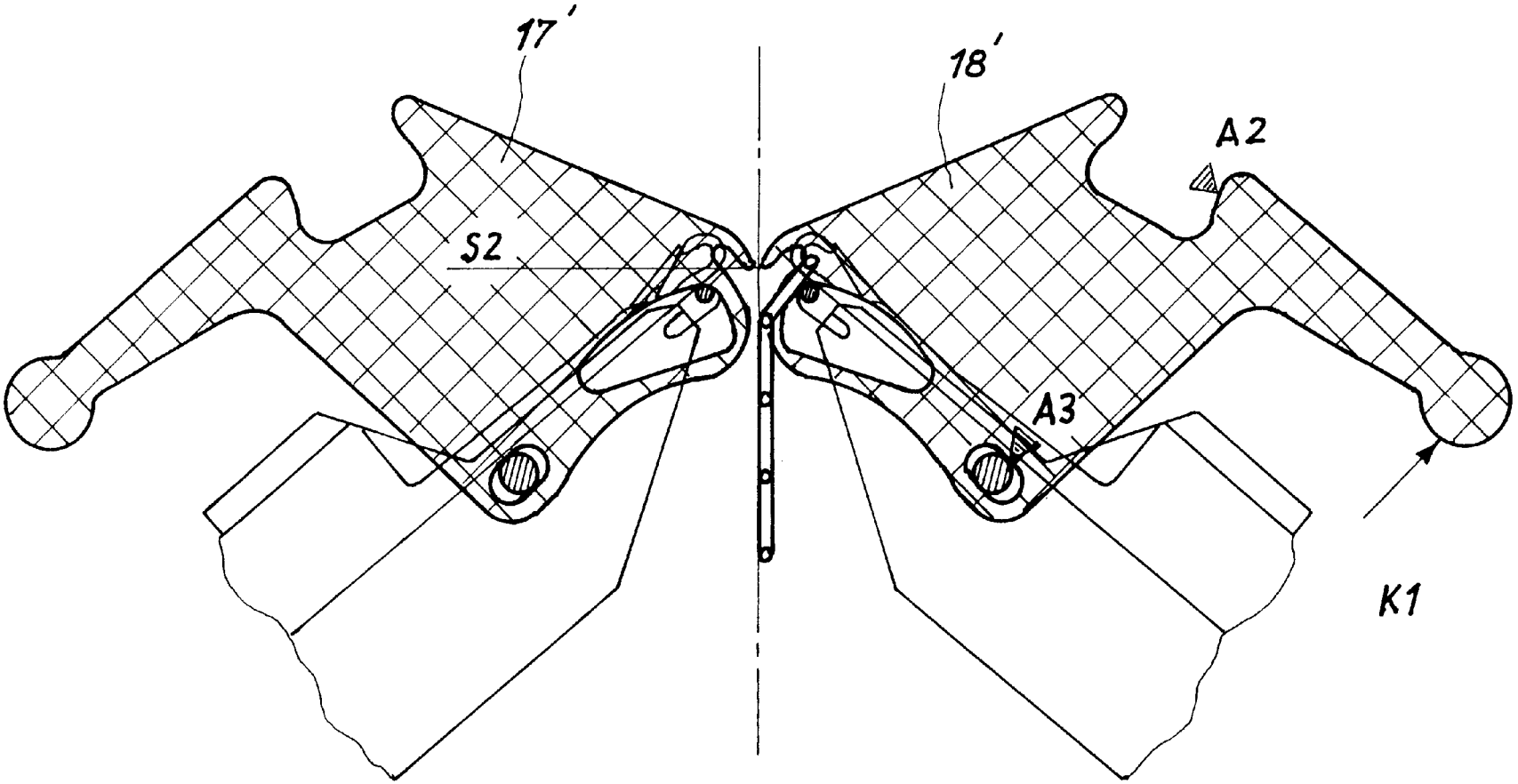
FIG. 15 is a cross-sectional view correspond to FIG. 4 showing the use of the second embodiments of these sinkers.

In FIGS. 14 and 15 a second embodiment of the sinkers 17' and 18', which have protruding front regions 17.1',18.1', which take over the task performed by the loop formers 27 and 28 in the sinkers 17,18 shown in FIGS. 2 to 8 and 10 to 11. FIG. 14 shows the sinkers 17' and 18' in a completely open configuration S0, while FIG. 15 shows the end position S2 of the sinkers 17' and 18'.

Figure 16:
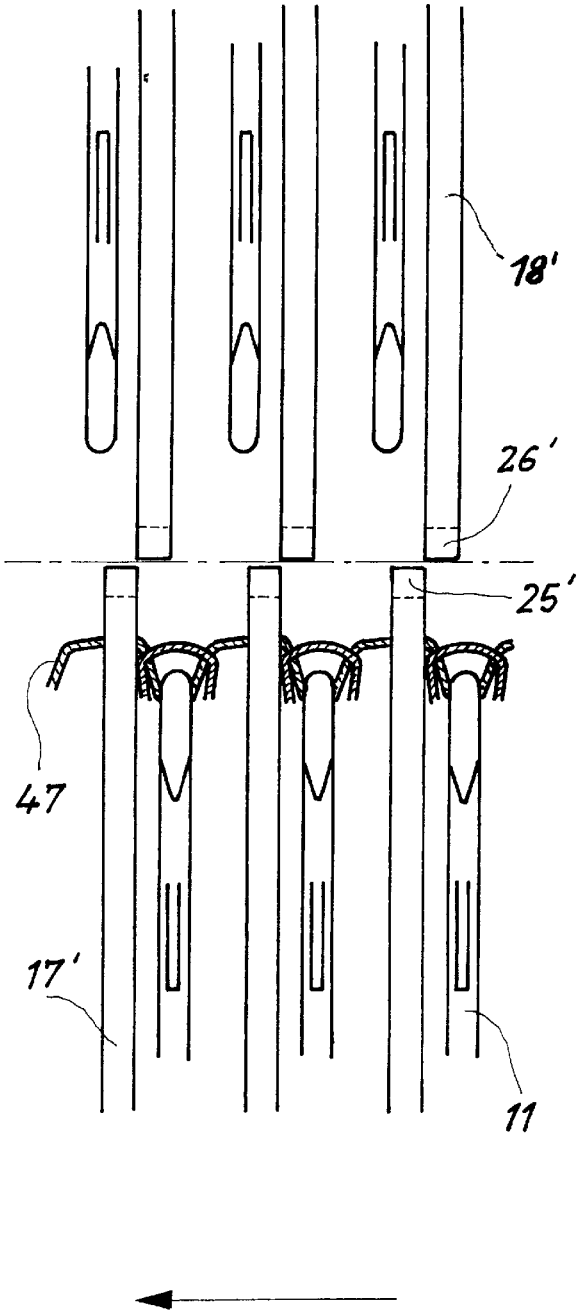
FIG. 16 is a top view corresponding to FIG. 12 on the cam gap region during use of the second embodiment of the sinkers.
Figure 17:
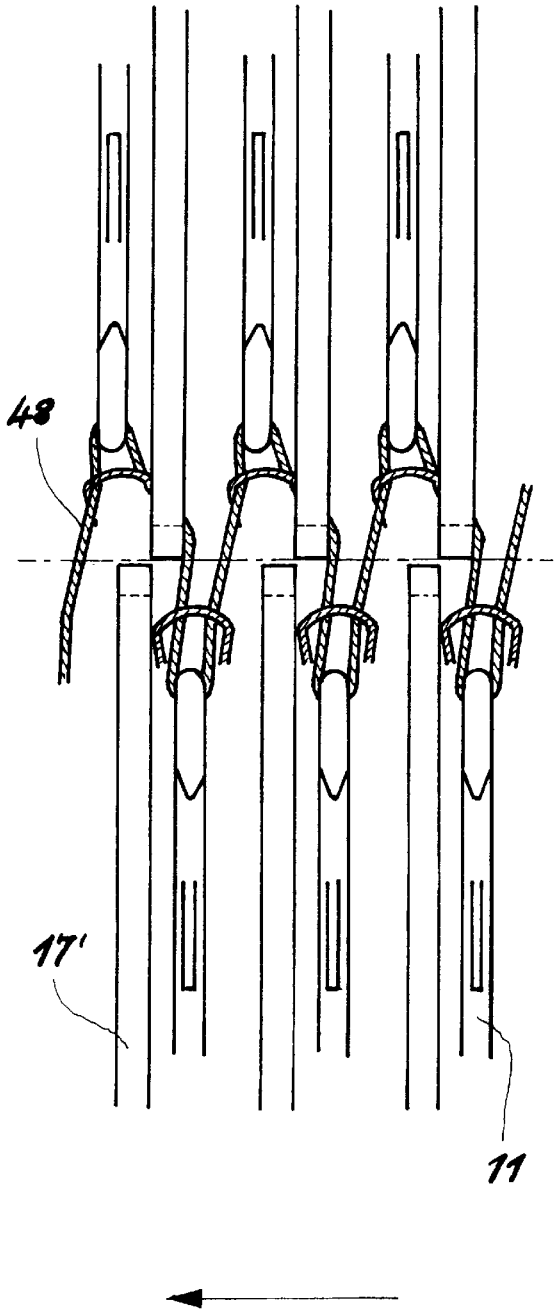
FIG. 17 is a top view corresponding to FIG. 13 of the cam gap region using the second embodiment of the sinkers.

FIGS. 16 and 17 correspond to FIGS. 12 and 13, however the sinkers 17,18 are replaced by the sinkers 17' and 18'. The sinkers 17',18' are considerably displaced relative to the sinkers 17,18. Here also the sinkers 17' and 181 span the cam gap of the sinker projections 25',26' in the end position S2 shown in FIGS. 16 and 17. The holding down action of the loops of the flat knit fabric 47 and/or of the two-sided knit fabric 48 by projections 25' and 26' on the side regions corresponds to the holding down by the projections 25 and 26 of the sinkers 17,18.

Figure 18:
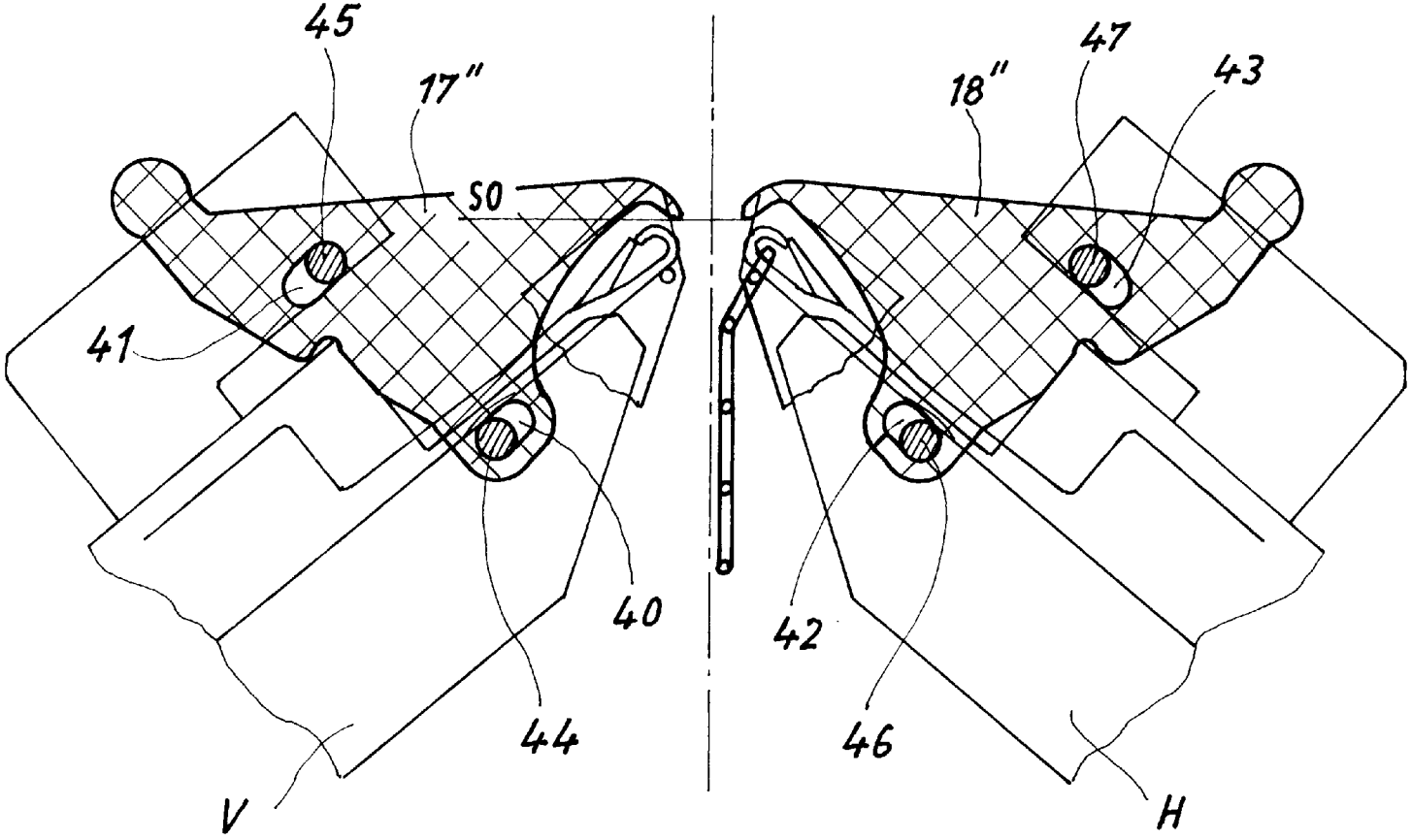
FIG. 18 is a cross-sectional view corresponding to FIG. 2 with a third embodiment of the sinkers.
Figure 19:
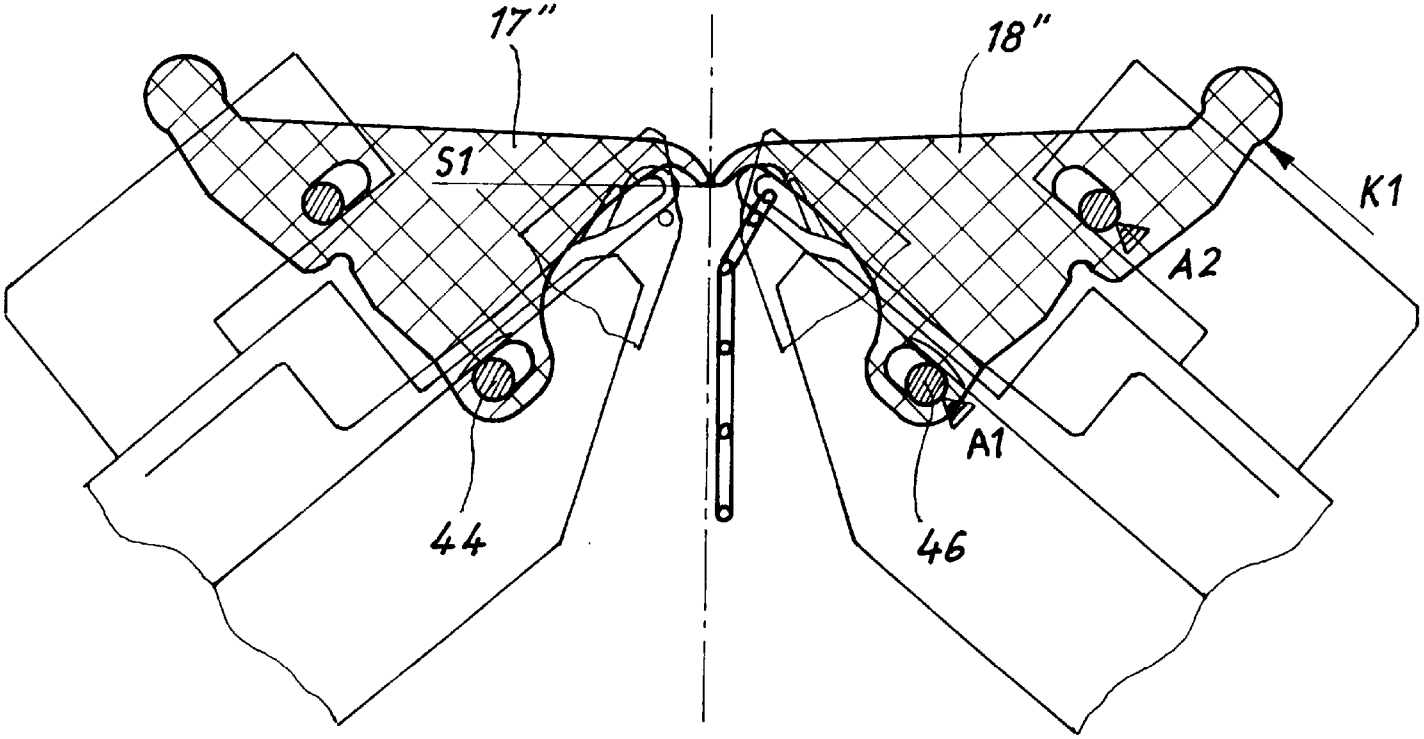
FIG. 19 is a cross-sectional view corresponding to FIG. 3 using the third embodiment of the sinkers.
Figure 20:
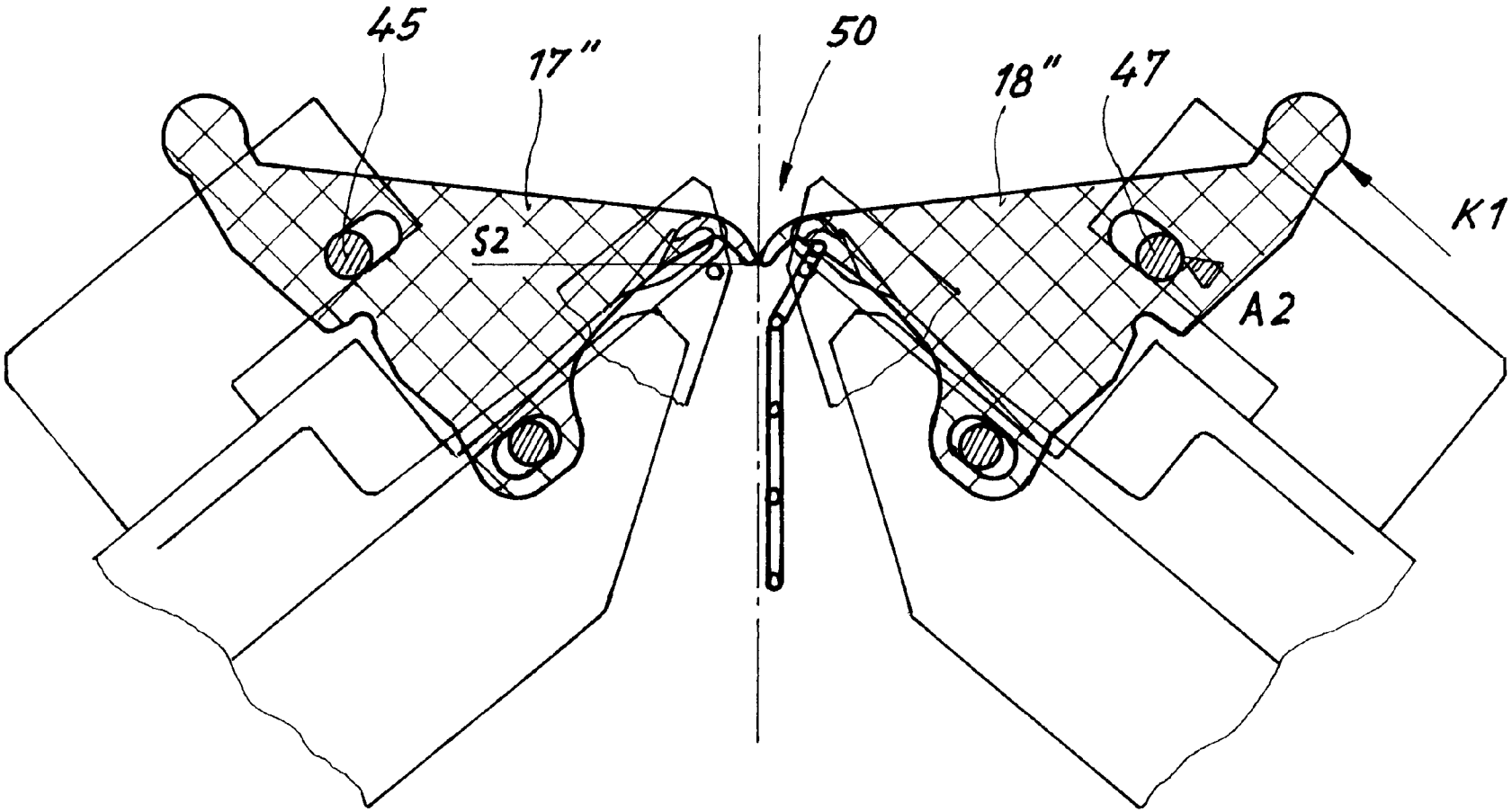
FIG. 20 is a cross-sectional view corresponding to FIG. 4 using the third embodiment of the sinkers.
Figure 21:
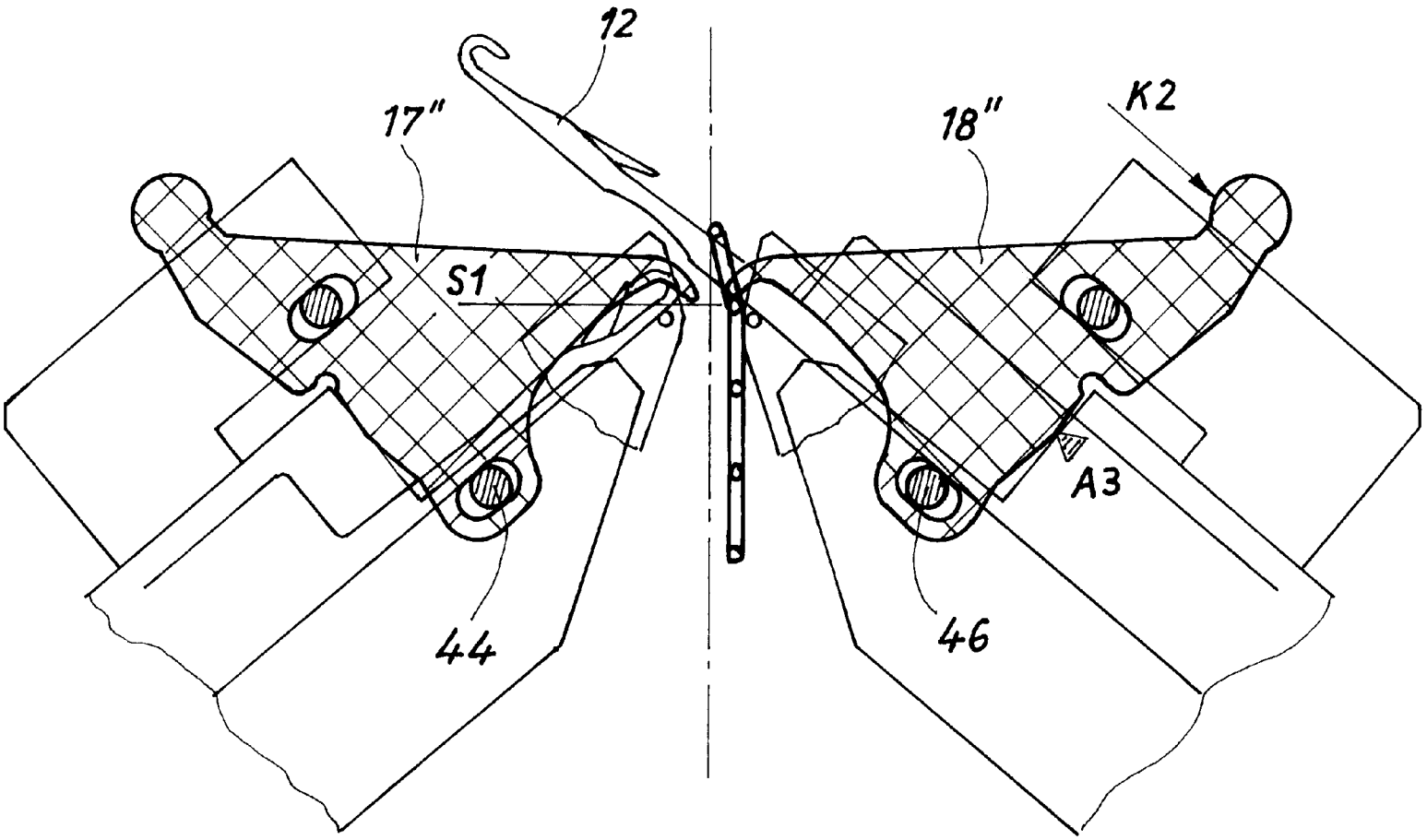
FIG. 21 is a cross-sectional view corresponding to FIG. 6 using the third embodiment of the sinkers.
Figure 22:
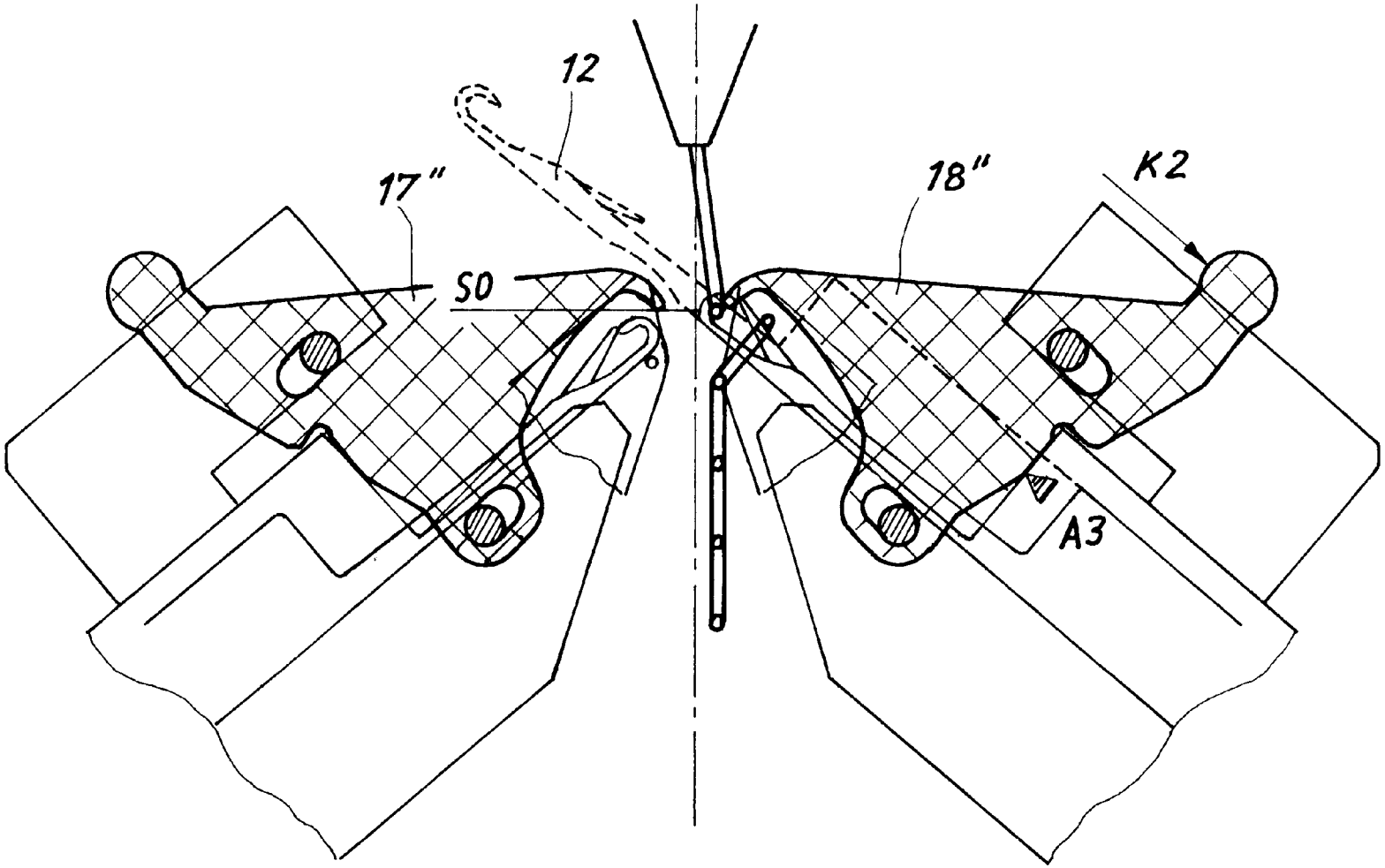
FIG. 22 is a cross-sectional view corresponding to FIG. 7 using the third embodiment of the sinkers.

FIGS. 18 to 22 show a third embodiment of the sinkers 17' and 18". In contrast to both of the previous embodiments the sinkers 17" and 18" are provided with two elongated holes 40,41 and/or 42,43 and mounted on the needle beds V,H with two different pivot shafts 44,45 and/or 46,47. FIG. 18 shows the sinkers 17" and 18" in their open position S0. In FIG. 19 the sinkers 17",18" are shown in their standard closed position S1. This position is attained by a rotary motion about the pivot shafts 44 and/or 46 by applying a force K1 while the sinkers 17",18" are supported in the region A1. The motion is finished when the sinkers 17",18" come into contact with the shafts at A2. FIG. 20 shows the sinkers 17" and 18" in their end position S2, in which the sinkers 17" and 18" are moved further inward into the cam gap 50 of the machine. The motion from the closed position S1 into the end position S2 occurs on application of the force K1. The sinkers 17" and 18" now perform a rotary motion about the pivot shafts 45 and/or 47 due to the support at A2. The sinkers 17" and 18" can be positioned continuously in every arbitrary position between the closed position S1 and the end position S2. FIG. 21 shows the drive of a needle 12, whereby the sinkers are brought by action of the force K2 into a closed position S1'. The sinkers 17" and 18" described a rotary motion about the shafts 44 and 46 until they come into contact with the shafts at the surface A3. In the sinkers shown open in FIG. 22 to facilitate the return or retraction of the needle 12 the force K2 acts again on the sinkers 17" and 18", whereby they perform a rotary motion about the point A3.

The disclosure in German Patent Application 197 04 644.4 of Feb. 7, 1997 is incorporated here by reference. This German Patent Application describes the invention, described hereinabove and claimed in the claims appended herein in below, and provides the basis for a claim of priority for the instant invention under 35 U.S.C. 119.

While the invention has been illustrated and described as embodied in a flatbed knitting machine, it is not intended to be limited to the details shown, since various modifications and changes may be made without departing in any way from the spirit of the present invention.

Without further analysis, the foregoing will so fully reveal the gist of the present invention that others can, by applying current knowledge readily adapt it for various applications without omitting features that from the standpoint of prior art, fairly constitute essential characteristics of the generic or specific aspects of this invention.

What is claimed is new and is set forth in the following appended claims:

1. A flatbed knitting machine for making a knit fabric from a yarn comprising a front needle bed (V) and a rear needle bed (H) arranged opposite each other and each provided with a respective plurality of longitudinally moveable needles (11,12)

front sinkers (17; 17', 17") moveably mounted in the front needle bed (V) and rear sinkers (18; 18', 18") moveably mounted in the rear needle bed (H), said front sinkers and said rear sinkers having a closed position (S1) and each being formed with a hook-shaped projection (25, 26; 25', 26'); and means for controlling said front sinkers and said rear sinkers comprising stationary cams (14,15) and moveable cams (16) arranged opposite each other across a cam gap (50) in the respective needle beds (V,H);

wherein said hook-shaped projections (25, 25') of said front sinkers (17; 17', 17") occlude or enclose sides of respective yarn loops formed on adjacent ones of the moveable needles (11) in the front needle bed (V) from above and said hook-shaped projections (26, 26') of said rear sinkers (18; 18', 18") occlude or enclose sides of respective yarn loops formed on adjacent ones of the moveable needles (12) in the rear needle bed (H) from above, when the front sinkers and the rear sinkers are in the closed position (S1); whereby reliable yarn loop formation and retention on said needles occurs during operation.

2. The flatbed knitting machine as defined in claim 1, wherein said front sinkers and said rear sinkers have an open position (S0) as well as the closed position (S1) and said means for controlling said front sinkers and said rear sinkers comprises means for moving said sinkers between the closed position (S1) and the open position (S0).

3. The flatbed knitting machine as defined in claim 2, wherein said means for controlling the front sinkers and the rear sinkers have an end position (S2) as well as the open position (S0) and the closed position (S1) and said means for controlling the front sinkers and the rear sinkers comprises means for continuously moving said front sinkers and said rear sinkers from the closed position (S1) into said cam gap (50) until said front sinkers and said rear sinkers are in said end position (S2).

4. The flatbed knitting machine as defined in claim 3, wherein said means for controlling said front sinkers and rear sinkers comprises means for continuously moving said sinkers (17,18; 17',18'; 17",18") from the open position (S0) into the closed position (S1) by pivoting said sinkers and from the closed position (S1) into the end position (S2) by a superimposed rotational and translational motion of said sinkers or by a purely rotational motion of said sinkers, wherein said sinkers (17,18; 17',18'; 17",18") perform a nearly vertical motion during said motions.

5. The flatbed knitting machine as defined in claim 4, wherein said means for controlling said sinkers includes means for applying a force to only one position on each of said sinkers (17,18; 17',18'; 17", 18") so as to move said sinkers from said open position (S0) to said closed position (S1) and from said closed position (S1) to said end position (S2).

6. The flatbed knitting machine as defined in claim 5, wherein said sinkers (17,18; 17',18'; 17",18") of both of said needle beds (V,H) and said hook-shaped projections (25,26; 25',26') of said sinkers form bridges spanning the cam gap (50) in said end position (S2) of the sinkers.

7. The flatbed knitting machine as defined in claim 6, wherein said means for controlling said sinkers (17,18; 17',18'; 17",18") comprises at least one elongated through going hole (21,22; 40,42) provided in each of said sinkers and respective pivot shafts (23,24; 25,26) provided in said needle beds (V,H) by means of which said sinkers are mounted rotatably and slidably with the respective pivot shafts (23,24; 44,46) extending through the elongated through going holes (21,22; 40,42).

8. The flatbed knitting machine as defined in claim 6, wherein said means for controlling said sinkers (17",18") comprises two elongated through going holes (40, 41, 42, 43) provided spaced apart from each other in each of said sinkers and respective pivot shafts (44,45,46,47) provided in said needle beds (V,H) by means of which said sinkers are mounted rotatably and slidably with the respective pivot shafts (44,45,46,47) extending through the elongated through going holes (40,41,42,43).

9. The flatbed knitting machine as defined in claim 7, further comprising stationary loop formers (27,28) arranged in the front and rear needle beds (V,H) cooperating with said sinkers (17,18; 17",18").

10. The flatbed knitting machine as defined in claim 7, wherein said sinkers (17',18') have front portions (17.1', 18.1') and further comprising means for forming loops including said front portions (17.1',18.1') of said sinkers.

11. A method for making a knit fabric of a predetermined fabric type from a yarn with a flatbed knitting machine, wherein said flatbed knitting machine comprises a front needle bed (V) and a rear needle bed (H) with respective pluralities of longitudinally movable needles (11,12), front sinkers (17, 17', 17") moveably mounted in the front needle bed (V) and rear sinkers (18, 18', 18") moveably mounted in the rear needle bed (H), said sinkers (17, 17', 17"; 18, 18', 18") each being formed with a hook-shaped projection (25, 25'; 26, 26') and having a closed position (S1), an end position (S2) and an open position (S0), and means for controlling said sinkers comprising stationary cams (14,15) and moveable cams (16) arranged opposite each other across a cam gap (50) in the respective needle beds, whereby said sinkers are moveable between the open position (S0) into the closed position (S1) by a pivoting motion of said sinkers and from the closed position (S1) into the end position (S2) by a superimposed rotational and translational motion of said sinkers, and said hook-shaped projections (25, 25') of said front sinkers (17, 17', 17") occlude or enclose sides of respective yarn loops formed on adjacent ones of the moveable needles (11) in the front needle bed (V) from above and said hook-shaped projections (26, 26') of said rear sinkers (18; 18', 18") occlude or enclose sides of respective yarn loops formed on adjacent ones of the moveable needles (12) in the rear needle bed (H) from above, when the front sinkers and the rear sinkers are in the closed position (S1);

wherein said method comprises the steps of:

a) closing each of the sinkers (17,18; 17',18'; 17",18") when the needle associated therewith is in a rest position so as to enclose or occlude the side of the yarn loop suspended from or hanging on said needle and to narrow a yarn-loop-containing space formed by motion of the sinkers (17,18; 17',18'; 17",18") in a direction toward said end position (S2);

b) extending said needle into an end position (R—R) thereof while said sinkers (17,18; 17',18'; 17",18") remain closed;

c) subsequently opening the yarn-loop-containing space by moving the sinkers (17,18; 17',18'; 17",18") into said closed position (S1) thereof;

d) shortly before retracting the needles and the inserting yarn into the needles, pivoting the sinkers (17,18; 17',18'; 17",18") into said open position (S0) thereof;

e) subsequently closing the sinkers (17,18; 17',18'; 17",18") shortly before the needles are advanced from a loop forming position (KT) to a cam level (KG); and f) according to the fabric type subsequently opening the sinkers or holding the sinkers in said closed position (S1) or said end position (S2).

* * * * *